United States Patent [19]

Sridhar et al.

[11] 4,168,967

[45] Sep. 25, 1979

[54] NICKEL AND COBALT IRREGULARLY SHAPED GRANULATES

[75] Inventors: Ramamritham Sridhar; Warren L. Shellshear, both of Mississauga; Carlos A. Landolt, Sudbury; William Kantymir; Howard L. Schooley, both of Port Colborne, all of Canada

[73] Assignee: The International Nickel Company, Inc., New York, N.Y.

[21] Appl. No.: 928,773

[22] Filed: Jul. 27, 1978

[30] Foreign Application Priority Data

Apr. 17, 1978 [CA] Canada ..... 301294

[51] Int. Cl.[2] ..... B22D 23/08

[52] U.S. Cl. ..... 75/0.5 C; 75/251; 264/11; 264/14

[58] Field of Search ..... 75/0.5 C, 0.5 BC, 251, 75/0.5 BA; 264/11, 14

[56] References Cited

U.S. PATENT DOCUMENTS 3,524,744 8/1970 Parikh ..... 75/0.5 BC

*Primary Examiner*—W. Stallard

*Attorney, Agent, or Firm*—L. Messulam; E. C. MacQueen

[57] ABSTRACT

A granulate consisting of smooth irregularly shaped granules is produced by preparing a molten bath of nickel and/or cobalt containing amounts of carbon and silicon which are correlated so that:

$$8.03\ C - 4.42\ C^2 + 7.23\ Si > 3.6$$

pouring the molten alloy at a temperature 50°-100° C. above its liquidus temperature onto the surface of a pool of water which is agitated and maintained at 30°-60° C.

9 Claims, 3 Drawing Figures

NICKEL AND COBALT IRREGULARLY SHAPED GRANULATES

FIELD OF THE INVENTION

The present invention relates to novel granulates and processes for producing them. It relates more particularly to granulates of metals and alloys comprising 95% or more of nickel and/or cobalt. (Unless otherwise specified, all percentages quoted in the present specification and claims are percentages by weight.)

BACKGROUND OF THE INVENTION

Granular forms of metals and alloys are desirable for use in many applications, notably where the metal or alloy is employed as feed stock to a melting process. For such a process, the attractions of using a granular feed as opposed to more conventional billet stock for example include the relative ease with which granulates can be melted in and uniformly distributed throughout a molten bath, as well as the potential for handling the granulates automatically and accurately metering the desired amount thereof.

Various techniques are known for producing metals and alloys in powder form. Such "atomization" techniques involve causing one or more atomizing streams of inert gas or water to impinge upon a stream of the molten metal to be atomized. Apart from the cost of such atomization processes, the resulting small particle size of the products inhibits their usefulness in many applications where, for example, dusting problems might be created. In such applications, it might be desirable to employ a particulate feed which is much coarser than the above mentioned powders, e.g., one consisting essentially of particles the diameter of which is greater than 2 mm or so, and preferably of the order of 25 mm or more. It is with the production of such particulate materials, rather than with powders, that the present invention is concerned, and the term "granulate" is used herein to denote such coarse particulate material.

Granulates have been produced for some time by the method commonly referred to as "shotting", wherein molten metal is discharged as a stream into a pool of water. While the technique is perhaps most closely associated with the production of lead shot, it has also been applied to metals of higher melting point than lead such as iron and steel. A recent process for the production of steel shot is described in U.S. Pat. No. 3,888,956, issued to N. J. Klint, in which a steel melt is poured as a vertical stream onto a horizontal flat surface of refractory material which causes the stream to be fragmented into droplets which then fall into a bath of cooling liquid. Drawbacks of this technique include frequent maintenance of the refractory material used as a disintegration surface, and the careful control needed to ensure that the stream of liquid metal to be disintegrated is approximately normal to the refractory surface at the point of impingement so that the metal stream is completely broken up. Apart from these drawbacks, the Klint patent does not provide an entirely satisfactory solution to the problem of producing nickel or cobalt shot which is suitable for remelting application.

When attempts are made to produce granulates of nickel or cobalt by the process described in the Klint patent, or by more conventional prior art shotting processes, two specific problems are encountered, namely, the tendency for the product to be in the form of smooth round granules and for these granules to possess undesirably high porosity. The sphericity of the granules is generally undesirable where they are intended for foundry use since they are unsuitable for handling by means of common conveyor belts and can pose safety hazards when industrial spills occur. Porosity of the granules is a more severe problem in that when granules of low density, i.e., having entrapped gases therein, are introduced into a molten bath, the sudden expansion of the entrapped gases leads to the phenomenon referred to as "thermal popping" whereby the added granules as well as some hot metal from the bath are made to spray out of the bath onto surrounding areas. The flying metal particles not only constitute a safety hazard, but also result in metal losses which may be substantial.

OBJECTS OF THE INVENTION

It is an object of the invention to provide a nickel and/or cobalt product which is in the form of smooth granules of irregular shape and of at least 2 mm diameter.

It is a further object of the invention to provide such products wherein the granules are of sufficiently high density so as effectively to eliminate the risk of thermal popping when they are used in a melting operation.

Yet another object of the invention is to provide a process suitable for producing such granulates on a commercial scale.

SUMMARY OF THE INVENTION

We have now found that the apparently distinct problems of granular sphericity and low density are not entirely unrelated, and that a common solution thereto lies in the combination of a suitable selection of the chemical composition of the granules to be produced and an appropriate choice of the conditions under which the granulation is performed.

According to the invention a granulate is produced by preparing a molten bath of alloy containing at least about 95% of nickel and/or cobalt, and about 0.1 to 2% of each of the elements carbon and silicon, the percentage of carbon and silicon being such as to satisfy the relationship:

$$8.03C - 4.42C^2 + 7.23Si > 3.6$$

discharging molten alloy from the bath as a stream having a temperature which is about 50°-100° C. above the liquidus temperature of the alloy, causing the stream to fall onto the surface of a pool of water, inducing agitation of the pool of water and maintaining its temperature at 30°-60° C.

Such a process provides a granulate consisting of smooth irregularly shaped granules having diameters of at least about 2 mm and a density of at least about 8 g/cc.

The proper selection of the alloy composition is critical to success of the process of the invention and affects both the product density and its morphology. Thus small amounts of carbon and silicon have a beneficial effect on the product density, though their effects differ in magnitude. However, the effect of the two alloying elements on product morphology is not the same. Carbon has been found to promote formation of round smooth granules, whereas silicon promotes irregularity of shape of the granules. It is therefore necessary to correlate the carbon content with the silicon content so as to achieve an optimum combination of product shape and density. Preferably, a combination of carbon and silicon is used in the amounts of about 0.4% carbon and 0.2% silicon with a product which contains at least 97% of nickel and/or cobalt. With such a composition, we have found that a density of 8.2 g/cc or higher can be achieved, by the process of the invention, in a product consisting of irregularly shaped granules ranging 3 mm to 25 mm in diameter. In general, the composition and granulation conditions should ensure a density of at least about 8 g/cc (i.e., about 90% of the theoretical density) if thermal popping is to be avoided upon remelting of the product.

As mentioned above, the conditions of granulation are also critical to achieving the desired properties of the product. It will be noted that in the process of the invention, the molten metal stream is not fragmented by directing a water jet at it during its free-fall, but is simply allowed to fall onto the surface of a pool of water. It is essential to induce agitation of the quenching water pool in order to provide therein a shearing action which promotes granule formation and prevents formation of large fused masses of metal at the bottom of the pool. While such agitation can be provided by means of mechanical stirring, we prefer to rely on a stream of water injected into the pool at a point below the pool surface and close to the point of impingement of the metal stream with the pool surface. This water stream serves a dual purpose. Firstly, it provides the required shearing action within the pool. Moreover, it serves as a means of controlling the pool temperature by a suitable choice of the flow rate of the water stream in relation to the flow rate of the metal stream to be granulated. Alternatively, where mechanical agitation is resorted to, it is necessary to include cooling coils within the quenching pool in order to maintain its temperature within the required limits.

The temperature of the water pool in which the molten stream is quenched must be in the range 30°-60° C., and preferably it is between 40° and 50° C. Such a temperature can be maintained by using a water stream of ambient temperature and correlating the flow rates of water and metal into the quenching bath in such a way that the flow rate of water is 8 to 10 times the flow rate of metal. A higher water temperature has been found to lead to a globular product which sometimes agglomerates into undesirably large lumps. Lower quenching temperatures have been found to lead to a stringy product rather than the desired smooth irregular granules.

Equally important is the temperature at which the molten stream is poured. This must not be less than 50° C. above the liquidus temperature of the alloy in order to avoid too early a solidification which would result in an undesirable stringy product. On the other hand, we have found that too great a superheat produces particles which are round and smooth and prevents the desired coarseness of particle size from being attained. Accordingly, the pouring temperature should be 50°-100° C. above the liquidus temperature of the alloy. Preferably the liquid metal stream is allowed to fall freely through a distance of about 30-60 cm before hitting the surface of the quenching water pool.

The invention will now be described by way of examples with reference to the accompanying drawings.

BRIEF DESCRIPTION OF THE DRAWINGS

FIGS. 2 and 3 are photographs which illustrate the morphology of products produced when conditions of the process of the invention are departed from.

EXAMPLE I

A 150 tonne nickel melt was produced by reduction smelting a commercial nickel oxide sinter with low sulfur coke in a fuel-fired furnace. By addition of the appropriate amounts of silicon and coke, the composition of the melt was adjusted to:

Copper: 1%
Cobalt: 1.2%
Iron: 0.4%
Sulfur: 0.1%
Silicon 0.2%
Carbon: 0.4%

Figure 1:
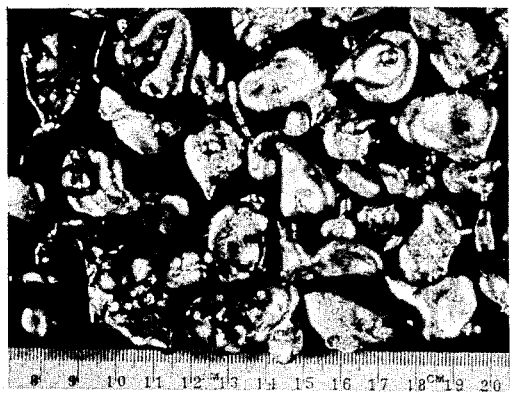
FIG. 1 is a photograph illustrating the shape and size of a nickel granulate produced in accordance with the invention.

The bath was tapped at a rate of 10,000 kg/h through a launder, the metal temperature at the end of the launder being 1,500° C. The stream of molten metal was allowed to fall through a distance of about 50 cm before hitting the surface of a pool of water. A stream of water was introduced at the rate of 90,000 kg/h into the quenching pool at a point about 15 cm below the pool surface. The water stream which was introduced at a relatively low pressure (about 35 kilopascals) was aimed orthoganally to the direction of flow of the metal through the quenching pool. The relative flow rates of metal and water into the quenching pool were found to maintain the temperature of the latter at about 50° C. The granulate recovered from the quenching pool was found, after drying, to have a density of 8.2 g/cc, which is 92% of the theoretical density of this product. The irregular shape of the granules produced can be seen in the photograph of FIG. 1 of the drawings. A screen analysis showed the size distribution to be as given in Table I.

TABLE I

| Size (mm) | Distribution (%) |
|---|---|
| < 3.2 | 0.8 |
| 3.2-6.4 | 10.4 |
| 6.4-9.5 | 24.9 |
| 9.5-12.7 | 21.1 |
| 12.7-25.4 | 41.6 |
| >25.4 | 1.2 |

The suitability of the granulate for foundry applications was investigated by charging it into a nickel melt at 1600° C. The product was found to melt smoothly without exhibiting any thermal popping.

EXAMPLE II

The effect of product composition on the density of the granules as well as their remelting characteristics was investigated in the following series of experiments. Nickel melts containing varying amounts of carbon and silicon were granulated by employing in all cases the procedure and conditions described in Example I. Following the granulation, the product density was determined and its melting characteristics investigated by charging 500 grams of dried granules into a nickel bath maintained at 1650° C. in an induction furnace. Satisfactory products melted in the bath with no visible sign of popping, whereas materials with too low a density resulted in ejection of metal from the bath, with the ejected material often traveling several meters in the air. Table II below depicts the results of 10 granulation tests, one of which (identified as Test No. 5) comprises the test of example I. Only the carbon and silicon contents of the various nickel melts are shown in Table II, since the remaining alloying elements (copper, cobalt, iron and sulfur) were in all cases present in the amounts specified in Example I. Also shown in Table II is the carbon-silicon correlation factor, i.e., the value of the expression ($8.03C-4.42C^2+7.23Si$), in each of the melt compositions.

TABLE II

| Test No. | % C | % Si | Correlation Factor, 8.03C-4.420 + 7.23S | Density g/cc | Density % theoretical | Melting Characteristics |
|---|---|---|---|---|---|---|
| 1 | 0.16 | 0.18 | 2.47 | 7.9 | 89 | Popping |
| 2 | 0.21 | 0.13 | 2.43 | 7.4 | 83 | Popping |
| 3 | 0.25 | 0.24 | 3.47 | 7.8 | 88 | Popping |
| 4 | 0.27 | 0.25 | 3.65 | 8.5 | 96 | No Popping |
| 5 | 0.40 | 0.20 | 3.94 | 8.2 | 92 | No Popping |
| 6 | 0.49 | 0.24 | 4.61 | 8.5 | 96 | No Popping |
| 7 | 0.42 | 0.36 | 5.20 | 8.4 | 94 | No Popping |
| 8 | 0.36 | 0.42 | 5.35 | 8.4 | 94 | No Popping |
| 9 | 0.69 | 0.22 | 5.03 | 8.4 | 94 | No Popping |
| 10 | 0.39 | 0.16 | 3.62 | 8.3 | 93 | No Popping |

It is evident from the above results that products having a density of above 8.0, i.e., exceeding 90% of the theoretical density, can be remelted satisfactorily, and that such a density was achieved consistently in all cases where the carbon-silicon correlation factor exceeded 3.6.

EXAMPLE III

Figure 2:
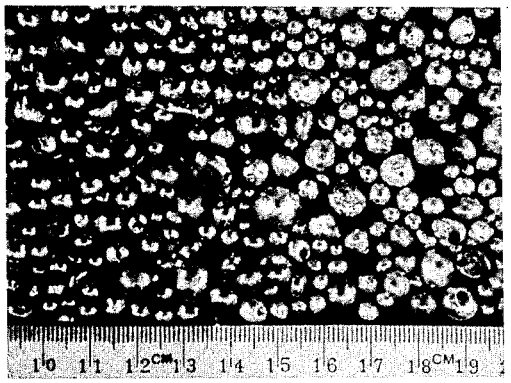

A granulation test was carried out on the same nickel melt used in Example I and under identical granulation conditions except that a higher nickel bath temperature was employed so that the metal stream exiting from the launder was at 1650° C., representing about 200° C. of superheat above the liquidus temperature. The resulting granules were smaller and more spherical than those obtained in the test of Example I, as can be seen from the photograph of FIG. 2. The result emphasizes the undesirability of employing a pouring temperature which is higher than 100° C. above the liquidus temperature of the alloy in question.

EXAMPLE IV

Figure 3:
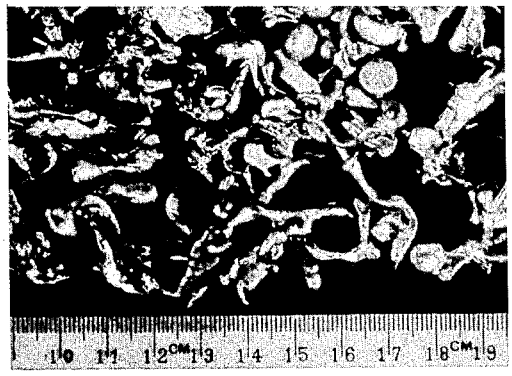

A further granulation test was carried out in a manner identical to that of Example I except that the quenching pool of water was maintained at 20° C. in this case. The structure of the resulting product can be seen in FIG. 3. The jagged stringy form of the granules is undesirable, and hence too low a quenching temperature is to be avoided.

It is to be understood that the compositions of the granules in the specific examples described are merely illustrative, and while we have described granulates which contain relatively small amounts of cobalt by comparison with nickel the invention is by no means restricted to production of essentially pure nickel. The granulation process of the invention can be successfully applied to various alloys of the nickel cobalt family, and such alloys may contain small amounts of iron or nonferrous metals providing the combined nickel and cobalt content constitutes at least 95% of the composition. Thus various modifications may be made to the details of the embodiments described without departing from the scope of the invention which is defined by the appended claims.

We claim:

1. A process for producing a granulate comprising preparing a molten bath of alloy containing at least about 95% nickel and/or cobalt, and about 0.1 to 2% of each of the elements carbon and silicon, such that the percentages of carbon and silicon satisfy the relationship:

$$8.03C-4.42C^2+7.23Si>3.6$$

discharging the molten alloy from the bath as a stream having a temperature which is about 50°-100° C. about the liquidus temperature of the alloy, causing the stream to fall onto the surface of a pool of water, inducing agitation of the pool of water and maintaining its temperature at about 30°-60° C.

2. A process as claimed in claim 1 wherein the agitator is induced by injecting a stream of water into the pool at a point below the pool surface and close to the point of impingement of the metal stream with the pool surface.

3. A process as claimed in claim 2 wherein the flow rates of the metal stream and water stream are correlated so as to maintain the pool at 40°-50° C.

4. A process as claimed in claim 3 wherein the water stream is at substantially ambient temperature and the correlation of the flow rates is such that the flow rate of the water stream is about 8 to 10 times the flow rate of the metal stream.

5. A process as claimed in claim 1 wherein the molten alloy contains at least about 97% of nickel and/or cobalt, about 0.4% carbon and about 0.2% silicon.

6. A process as claimed in claim 5 wherein the metal stream is allowed to fall under gravity through a distance of about 30 to 60 cm before contacting the surface of the pool.

7. A granulate suitable for adding to a metallurgical melt comprising at least about 95% of nickel and/or cobalt, and about 0.1 to 2% of each of the elements carbon and silicon, such that the percentages of carbon and silicon satisfy the relationship:

$$8.03C-4.42C^2+7.23Si>3.6$$

the granulate consisting of smooth irregularly shaped granules having diameters of at least about 2 mm and a density of at least about 8 g/cc.

8. A granulate as claimed in claim 7 wherein the granules contain at least about 97% of nickel and/or cobalt, about 0.4% carbon and about 0.2% silicon, and have a density of at least about 8.2 g/cc.

9. A granulate as claimed in claim 7 wherein substantially all of the granules range in size between 3 mm and 25 mm in diameter.

* * * * *